United States Patent [19]

Inoue

[11] 4,310,256

[45] Jan. 12, 1982

[54] PRINTERS

[75] Inventor: Ikutaro Inoue, Morioka, Japan

[73] Assignee: Alps Electric Co., Ltd., Tokyo, Japan

[21] Appl. No.: 77,797

[22] Filed: Sep. 24, 1979

Related U.S. Application Data

[63] Continuation of Ser. No. 815,714, Jul. 14, 1977, abandoned.

[30] Foreign Application Priority Data

Jul. 15, 1976 [JP] Japan ..... 51-84346

[51] Int. Cl.[3] ..... B41J 1/24; B41J 19/94

[52] U.S. Cl. ..... 400/185; 400/184; 400/317.2; 400/322; 400/320; 101/93.17; 101/93.19; 400/568; 400/314.1

[58] Field of Search ..... 400/184, 185, 310, 317, 400/317.2, 320, 322, 568, 335, 329.3, 334.1, 314.1, 319, 330, 320.1, 336, 331.1, 333.3, 154; 101/93.15, 93.17, 93.19

[56] References Cited

U.S. PATENT DOCUMENTS

| | | | |
|---|---|---|---|
| 2,937,736 | 5/1960 | Kuntzel | 400/335 |
| 3,098,608 | 7/1963 | Dombrowski | 400/317 |
| 3,227,259 | 1/1966 | Howard | 400/154.2 |
| 3,461,235 | 8/1969 | Wilcox et al. | 101/93.15 |
| 3,578,129 | 5/1971 | Kato | 400/317 |
| 3,685,629 | 8/1972 | Rott | 400/314.1 |
| 3,795,300 | 3/1974 | Matsuzawa | 101/93.17 |
| 3,884,341 | 5/1975 | Wagner | 101/288 |
| 3,986,594 | 10/1976 | Kondur, Jr. | 400/185 |
| 4,030,588 | 6/1977 | Hanagata et al. | 400/185 |
| 4,051,942 | 10/1977 | Suzuki et al. | 400/154.5 |
| 4,062,436 | 12/1977 | Kondur, Jr. et al. | 400/185 |

*Primary Examiner*—William Pieprz

*Attorney, Agent, or Firm*—Guy W. Shoup; Gerard F. Dunne

[57] ABSTRACT

In an extra-small sized printer of the so called serial type, which prints one character every time a type wheel is shifted by a distance corresponding to one character in the direction of the line of typing, the simplification of a driving source as well as the simplification of the overall mechanism are accomplished by a modification of the system.

6 Claims, 13 Drawing Figures

PRINTERS

This application is a continuation of application Ser. No. 815,714 filed July 14, 1977 and now abandoned.

BACKGROUND OF THE INVENTION

This invention relates to an extra-small sized printer which can be installed in an electronic desk top calculator, and more particularly to the so called serial type printing mechanism wherein one character is printed every time a type wheel is shifted by a distance corresponding to one character in the direction of the line of typing.

SUMMARY OF THE INVENTION

In the printer of the present invention, the simplification of a driving source as well as the simplification of the mechanism have been accomplished by such modifications as driving the hammers and the shifting a type wheel by a first electromagnetic plunger, and returning the type wheel to the start position for shifting and the feeding of paper by a second electromagnetic plunger.

BRIEF DESCRIPTION OF THE DRAWINGS

The invention and one specific embodiment thereof will be described hereinafter by way of example and with reference to the accompanying drawings wherein like reference numerals refer to like elements or parts and in which.

DESCRIPTION OF THE PREFERRED EMBODIMENTS

Figure 1:
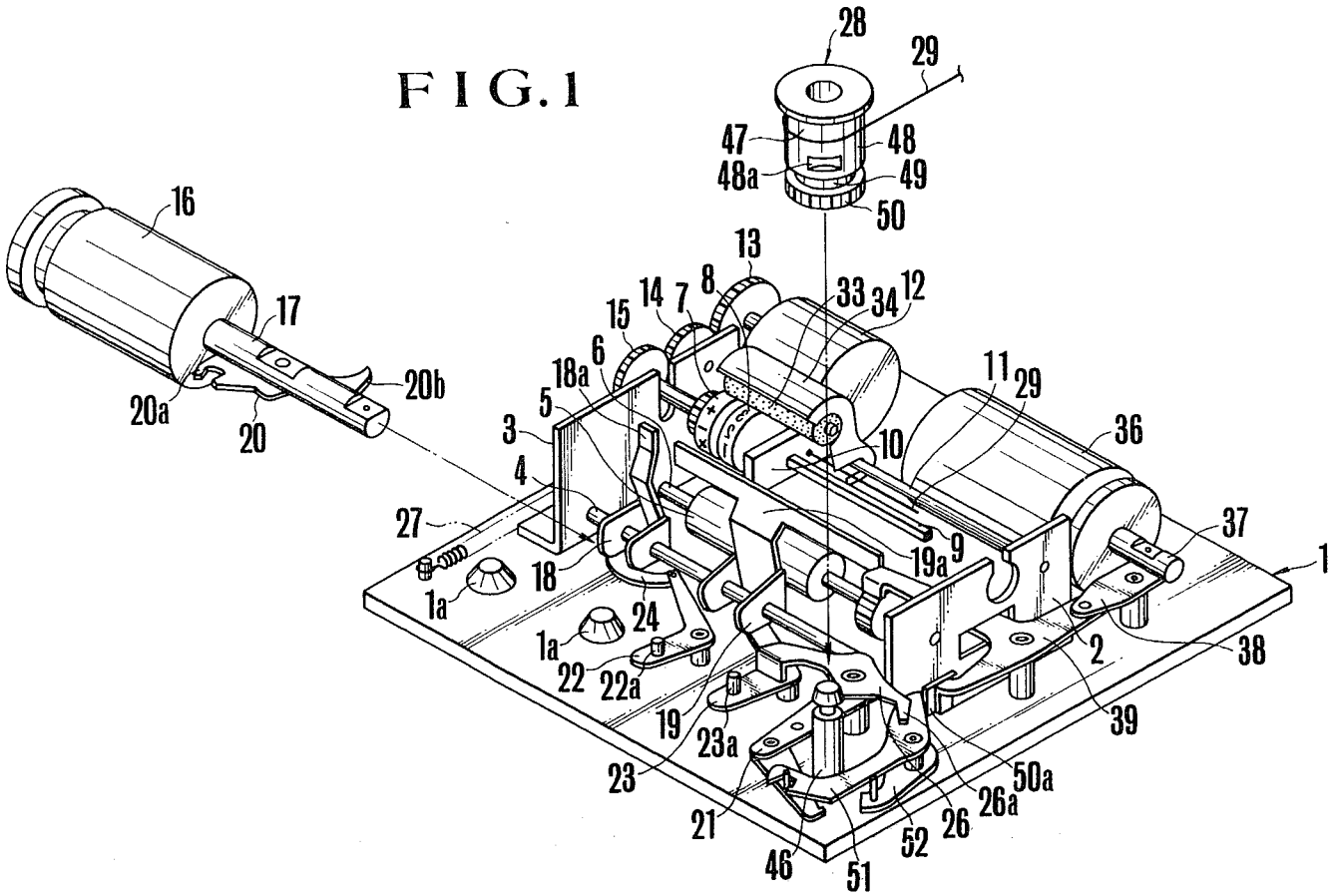
FIG. 1 shows a partly-exploded schematic perspective view of one of the embodiments in accordance with the present invention.

Referring particularly to FIG. 1, reference numeral 1 shows a base stand on which support frames 2 and 3 are mounted. A hammer shaft 4, a support shaft 6 for a paper feed roller 5, a spline shaft 9 for type wheels 7 and 8, and a guide shaft 11 used for guiding a carriage 10 of the type wheel 8 are all mounted on the support frames 2 and 3. In this arrangement, the shafts 6 and 9 are rotatably mounted, but the shafts 4 and 11 are fixedly supported. Positional relations, among the four shafts 4, 6, 9 and 11, which perform an important function in the printing mechanism, are determined merely by mounting the support frames 2 and 3 on the base stand 1.

Reference numerals indicate a step motor 12 attached to the base stand, a drive gear 13 fixed to the shaft of the motor 12, an intermediate gear 14 pivotably mounted on the support frame 3, and a transmission gear 15 fixed to the spline shaft 9. Rotation of the motor 12 is transmitted to the spline shaft 9 through the gear train comprising gears 13, 14 and 15 to rotate the type wheels 7 and 8, fixed to spline shaft 9, through a given angle.

Reference numeral 16 shows an electromagnetic plunger, i.e. solenoid (first electromagnetic plunger), which functions as a driving source for the printing operation and the shifting operation of the type wheel 8. In FIG. 1, the plunger 16 is shown in a state where it is detached from the base stand 1 for the sake of illustration, but in reality, it will be fixed on the mounting stands 1*a*, 1*a* of the base stand 1 by means of screws or the like. 17 is an operating lever of the electromagnetic plunger 16. Pivotably mounted on the middle portion of the operating lever 17 is a seesaw type lever 20 for switching the driving of hammers 18 and 19 to be described later, and a feed lever 21 is coupled to the forward end thereof for driving a ratchet 50 to be also described later. (Refer to FIG. 7).

The hammers 18 and 19 are rotatably mounted on the hammer shaft 4 and include hammer heads (knocking arms) 18*a* and 19*a* formed at the forward ends thereof and used for hammering the type wheels 7 and 8 through a paper. The hammer heads 18*a* and 19*a* are formed so as to have a width corresponding to that of the type wheel 7 and the amount of shifting of the type wheel 8 to be shifted, respectively.

Figure 4:
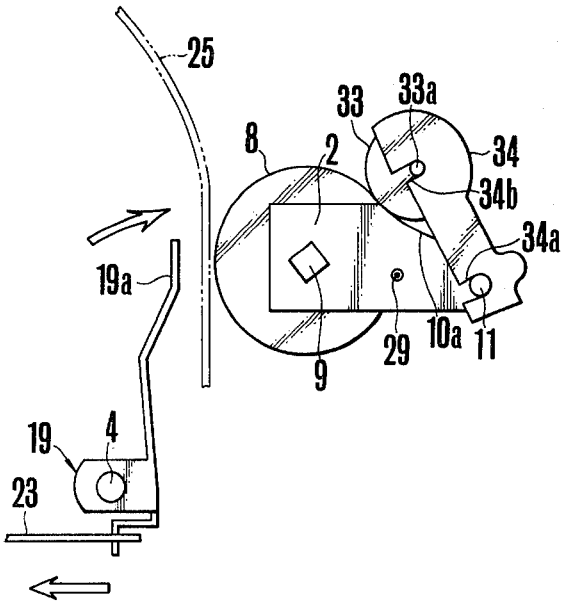
FIG. 4 shows a side view illustrating the relationship between hammers and type wheels.

22 and 23 show rotating levers of "L"-shape, which respectively are used to transmit the motion of the electromagnetic plunger 16 to the respective hammers 18 and 19 and which are pivotably mounted at the center portions thereof on the base stand 1. One end of the rotating lever 22 is provided with a pin 22*a* which freely abuts on the cam portion 20*a* of the seesaw type lever 20, and the other end of which is coupled to an intermediate member 24 fixed to the lower part of the hammer 18, Similarly, one end of the rotating lever 23 is provided with a pin 23*a* which freely abuts on the cam portion 20*b* of the seesaw type lever 20, and the other end of which is coupled to the lower part of the hammer 19. In short, when the lower part of the hammer 19 (or 18) is pulled in the direction of the arrow, along the axis of the plunger arm, by means of the rotating lever 23 (or 22), the hammer head 19*a* (or 18*a*) is turned (centering on the hammer shaft) to hit the type wheel 8 (or 7) through a paper 25 as shown in FIG. 4. In addition, the cam portion 20*b* of the seesaw type lever 20 abuts on one end of a change-over arm 26 to be described later (Refer to FIG. 7) and the seesaw type lever 20 is rotated in response to the revolution of the change-over arm 26 so that it is associated with either one of the hammer 18 or 19.

The type wheels 7 and 8 are provided with types on the periphery thereof for printing. The type wheel 7 is used for printing only function symbols such as + and − and may not be moved in the axial direction since it is fixed to the spline shaft 9. On the other hand, the type wheel 8 is used for printing numerical symbols such as numerals, negative symbol, and decimal point, and so constructed that it is freely slidable over the spline shaft 9 in the direction of shifting by means of the carriage 10.

Figure 2:
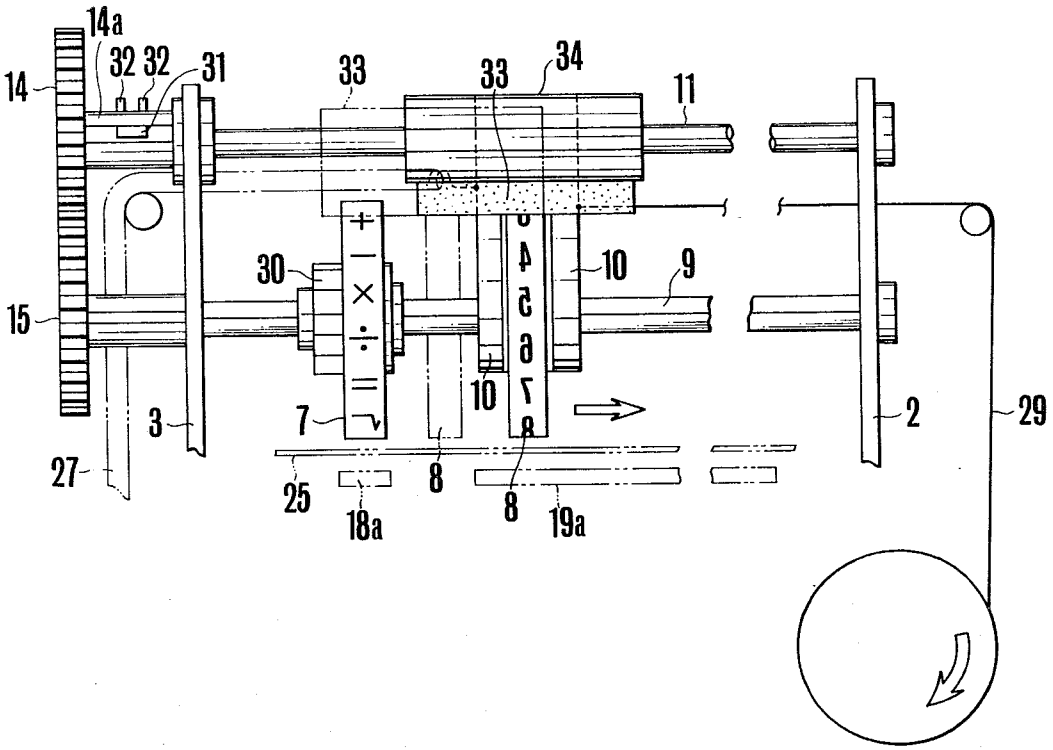
FIG. 2 shows a main portion useful for explaining the present invention.
Figure 3:
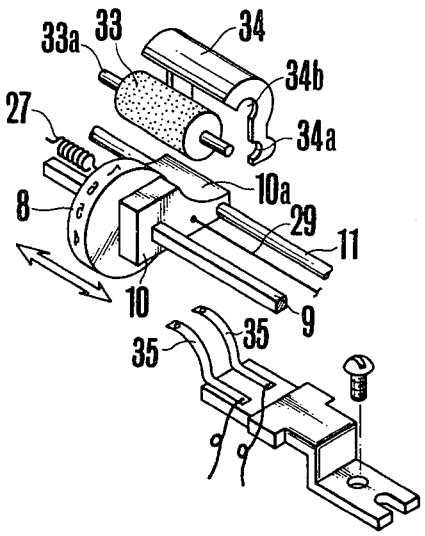
FIG. 3 shows a partly-extracted perspective view on parts to be shifted.

As can be clearly understood from FIGS. 1, 2 and 3, the carriage 10 is so constructed that it can be freely slid in the axial direction along the spline shaft 9 and the guide shaft 11, and is always pulled in the left (in FIG. 2) by means of a coil spring 27 stretched between the base stand 1 and the side wall of the carriage 10. One end of a comparatively thin rope 29 (filament) is wound around a take-up drum 28 and the other end of which is coupled to the side wall of the carriage 10. When the take-up drum 28 is rotated in the direction of the arrow in FIG. 2 and the rope 29 is taken up, the carriage 10 is transferred toward the right side.

In FIG. 2, a ratchet 30 (a wheel with ratchet peripheral teeth) mounted on the spline shaft 9 is integral with the type wheel 7 and has a number of teeth equal to the number of symbols formed on the type wheels 7 and 8, and is maintained at the desired position by means of a claw (not seen in FIG. 2 as located at the rear side) which engages a tooth portion of the ratchet 30 when any one of the symbols of the type wheel 7 or 8 is selected. In addition, a conductor piece 31 embedded in an insulating shaft portion 14*a* of the intermediate gear 14 comes into contact with a contact terminal mounted on the base stand 1 for every revolution of the intermediate gear 14 to detect the start position at every revolution of the spline shaft 9 running at the same number of revolutions with the intermediate gear 14.

As illustrated in FIGS. 3 and 4, a slope 10*a* is formed on the rear part of the carriage 10, and an ink roller 33 impregnated with ink is detachably mounted on the slope 10*a*. A cover 34 for the ink roller 33, which cover is mounted on the guide shaft 11, is provided with a bearing portion 34*b* which receives the shaft 33*a* of the ink roller 33. In short, the cover 34 is mounted on the guide shaft 11 in such manner that the bearing portion 34*b* carries the ink roller 33 and the carriage 10 is included therein. When the cover 34 is set in place through the fitting of the base edge 34*a* into the guide shaft 11, the ink roller 33 is shifted together with the carriage 10 while constantly abutting the type wheel 8 under appropriate pressure. However, alternatively and not shown, it may be so constructed that the required contact pressure is obtained by a spring stretched between the cover 34 and the carriage 10.

In addition, when the ink roller 33 is in the start position of the shifting the type wheel 8 as indicated by two-dot chain line in FIG. 2, it is also in contact with the type wheel 7, so that it serves as single supply source of ink for the type wheels 7 and 8. To check the return of the type wheel 8 to the shifting start position, contact pieces 35 are installed on the base stand 1. When returned, the contact pieces 35 come into touch with contact pieces (not shown) embedded in the carriage 10 at the lower plane thereof.

Figure 5:
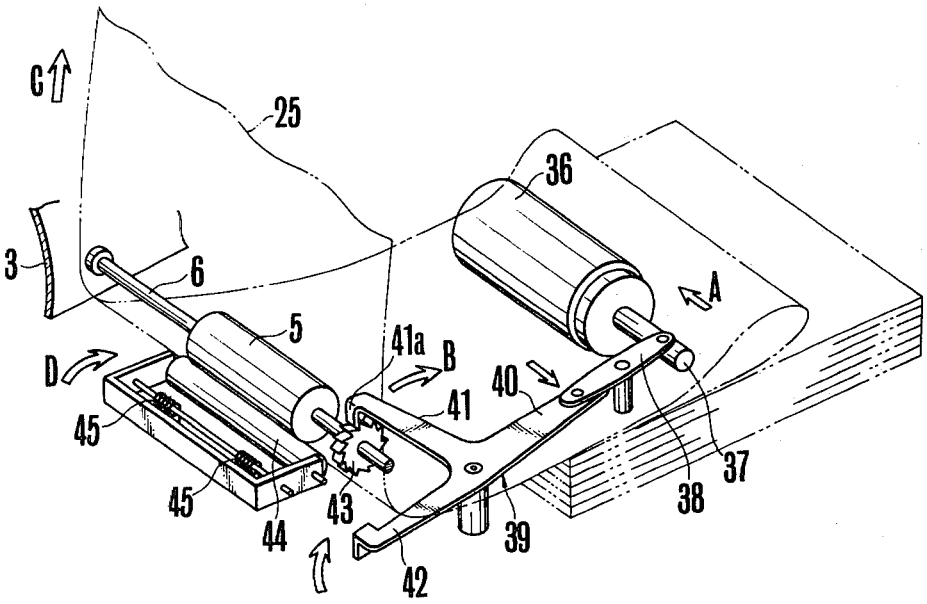
FIG. 5 shows a simplified perspective view illustrating a paper feed mechanism.

As clearly indicated in FIGS. 1 and 5, an electromagnetic plunger 36, which is the second electromagnetic plunger, starts to operate upon the completion of printing of one line by both type wheels 7 and 8. The plunger 36 is arranged to control the operation of paper feeding as well as the return operation of the type wheel 8 to its starting position for shifting.

Reference numerals 37 and 38 show an operating bar for the electromagnetic plunger 36 and a coupling lever pivoted on the base stand 1, respectively. One end of the coupling lever 38 is coupled to the operating bar 37, and the other end of which is coupled to an arm 40 of a T-link 39 to be described later. The T-link has three arms 40, 41 and 42 and is pivoted on the base stand 1 at its center portion. At the forward end of the arm 41 is formed a feed claw 41*a* which engages a ratchet 43 fixed to the support shaft 6 of the paper feed roller 5. When the operating bar 37 of the electromagnetic plunger 36 is operated in the direction of arrow "A" in FIG. 5, the arm 41 is turned in the direction of arrow "B" through the coupling lever 38 to rotate the support shaft 6 by the desired angle. As illustrated in FIG. 5, the roller 5 mounted on the support shaft 6 abuts upon a follower roller 44 mounted on the base stand 1 through the paper 25 and feeds the paper 25 in the direction of arrow "C" as the support shaft 6 is rotated. Since the paper 25 is loaded at the under portion of the base stand 1 in the folded condition, it will be led out between the roller 5 and the follower roller 44 through an elongated slit (not shown) in the base stand 1. In FIG. 5, the follower roller 44 is always biased by means of a coil spring 45 in the direction of arrow "D".

Figure 6:
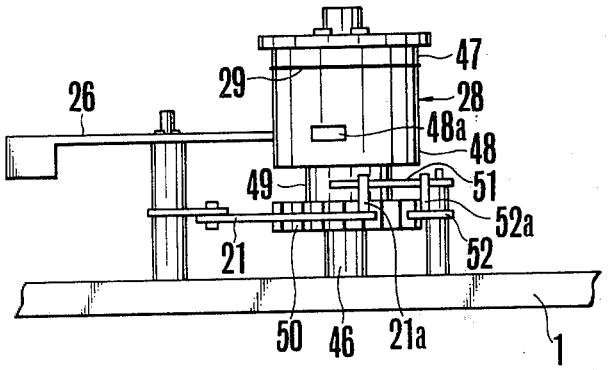
FIG. 6 shows a front view of a main portion associated with a take-up drum.

As is clearly seen in FIGS. 1 and 6, the take-up drum 28 is rotatably pivoted on a pole brace 46 fixed to the base stand 1 and includes a take-up portion 47 for the rope 29, an abutting portion 48 for the change-over arm 26, a stepped portion 49 coupled to the abutting portion 48, and a ratchet 50 coupled to the stepped portion 49. One end of the rope 29 is fixed to the take-up portion 47, and the other end of which is coupled to the carriage 10. The tractive force of the coil spring 27 is also applied to the take-up drum 28 by way of the carriage 10, so that the drum 28 is always pulled in the counterclockwise direction in FIG. 1. A projection 26*a* at one end of the change-over arm 26 pivotably mounted on the base stand 1 abuts upon the abutting portion 48 (Refer to FIG. 7). The projection 26*a* is constructed to engage into a concave portion 48*a* disposed on the abutting portion 48, when the type wheel 8 is located at the start position for shifting.

A release arm 51 is pivotably mounted at its middle portion on the base stand 1 and has one end located at the stepped portion 49. The other end 50*a* of the release arm 51 abuts on the arm 42 and only when the arm 42 is being rotated said one end of the release arm 51 abuts on the feed lever 21 and a detention claw 52.

Figure 7:
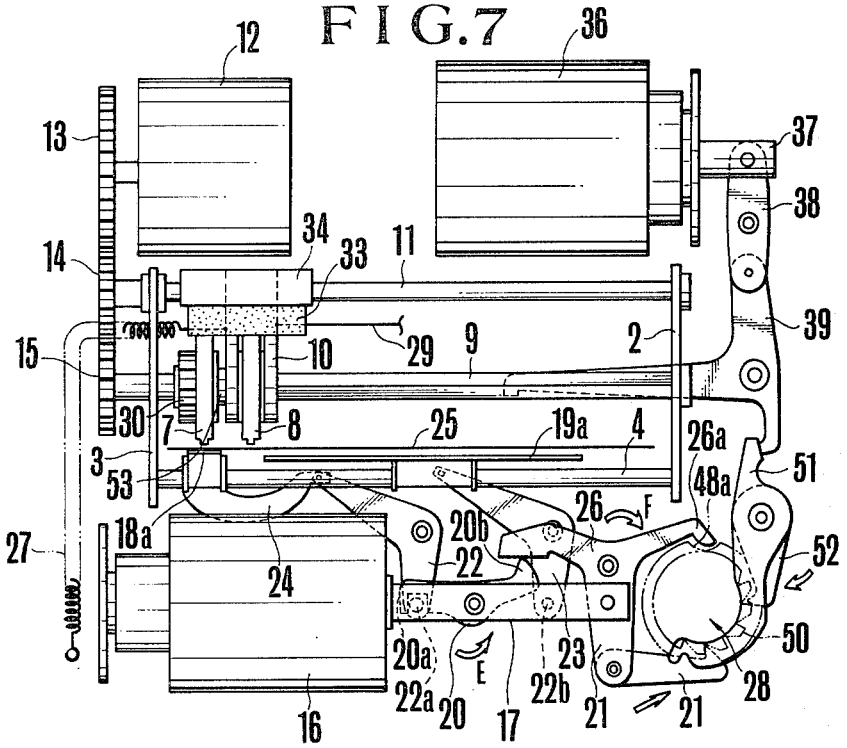
FIGS. 7–12 show partly-simplified drawings useful for explaining the operation of printing.

In addition, the ratchet 50 engages the forward end of the feed lever 21 pivotably mounted on the shaft for the change-over arm 26 and the detention claw 52 pivotably mounted on the shaft for the release arm 51 (Refer to FIGS. 6 and 7).

The operation of the printer according to the preferred embodiment will be hereinafter explained by mainly referring to FIGS. 7–13.

In FIG. 7 which is illustrating the condition of printing mechanism before operation, the carriage 10 is pulled by the coil spring 27 and abuts on a stopper 53 to position the type wheel 8 so as not to face the hammer head 19*a*. The take-up drum 28 coupled to the carriage 10 by way of the rope 29 is stopped in such manner that the projection 26*a* of the change-over arm 26 engages the concave portion 48*a* in the abutting portion 48. In other words, the seesaw type lever 20 pivoted on the operating lever 17 for the first electromagnetic plunger 15 is being pulled in the direction of arrow "E" in FIG. 7 by means of a spring (not shown) to turn in the direction of arrow "F" the change-over arm 26 abutting on the cam portion 20*b* located on one end of the lever 20. Thus, the projection 26*a* in the change-over arm 26 is in engagement with the concave portion 48*a*, and the cam portion 20*a* located on the other end of the seesaw type lever 20 is in engagement with the pin 22*a* in the rotating lever 22. In addition, the feed lever 21 and the detention claw 52 which are to engage in the ratchet 50 of the take-up drum 28 are being pulled toward the ratchet 50 by means of respective springs (not shown) and will repeat the engagement and disengagement with its tooth portion as the ratchet 50 is rotated.

Figure 8:
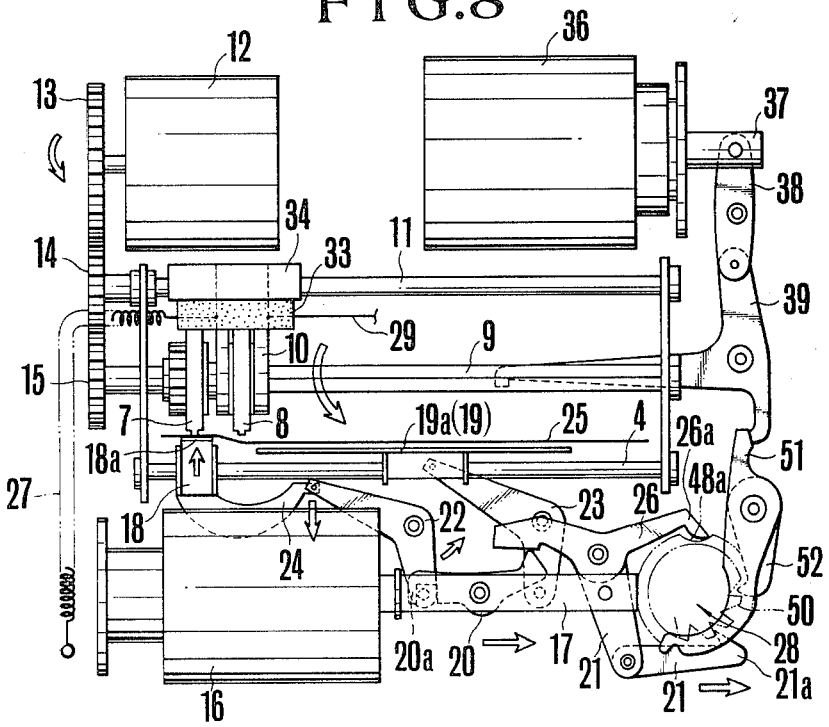
Figure 9:
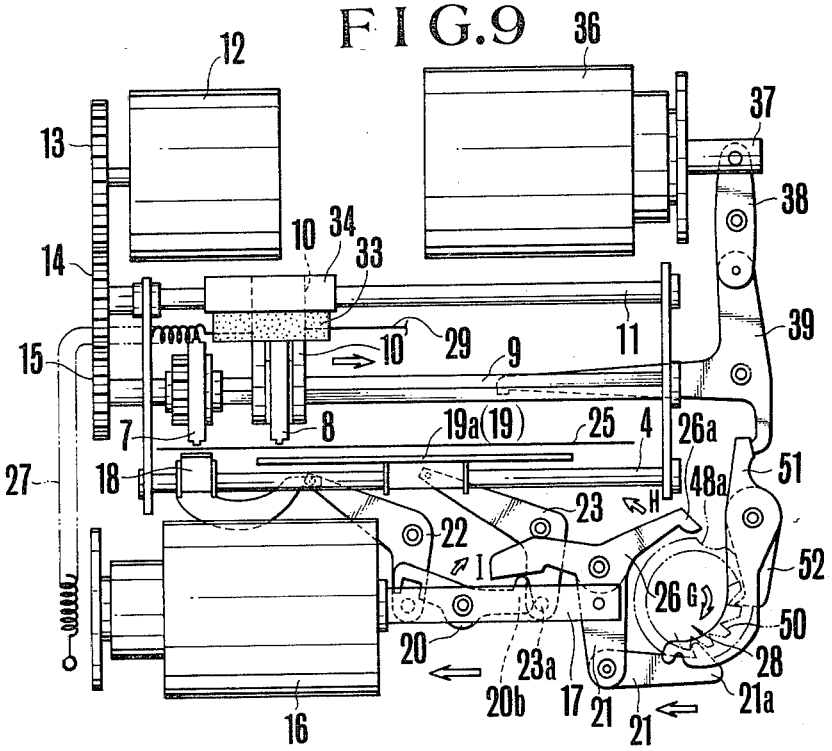

When a printing instruction from a control circuit is applied to the printing mechanism in FIG. 7 (although a key is not illustrated in the drawing, the printing instruction for one line can be obtained by depressing a print command key in an electronic desk top calculator or operation command key in this embodiment), the rotation of the step motor 12 is transmitted to the type wheel 7 through the spline shaft 9, and the type wheel 7 is thereafter stopped at the position where any function symbol corresponding to the required print command symbol faces the hammer head 18*a*. In response to the stoppage of the type wheel 7, the electromagnetic plunger 16 is actuated in the direction of arrow as illustrated in FIG. 8 to turn the hammer 18 by way of the seesaw type lever 20 on the operating lever 17, the rotating lever 22, and the intermediate member 24. And then, the hammer head 18*a* hits the type wheel 7 through the paper 25. As the result, the required function symbol is printed on the paper 25. At this juncture, the feed lever 21 coupled to the forward end of the operating lever 20 is advanced up to the position that corresponds to the next tooth portion of the ratchet 50.

In the subsequent step, when the power to the electromagnetic plunger 16 is interrupted and the operating lever 17 is returned to its initial position by means of the spring incorporated in the electromagnetic plunger 16, the hammer 18 is turned in the reverse direction with respect to the aforesaid direction by way of the seesaw type lever 20 on the operating lever 17, the rotating lever 22, and the intermediate member 24 to release the hammer head 18*a* from the type wheel 7. At the same time, the ratchet 50 (take-up drum 28) is rotated by means of the feed lever 21 coupled to the operating lever 17 in the direction of arrow "G" in FIG. 9. When the take-up drum 28 is rotated, the projection 26*a* of the change-over arm 26 is released from the concave portion 48*a* of the take-up drum 28 to turn the change-over arm 26 in the direction of arrow "H". Thus, the seesaw type lever 20 is rotated in the direction of arrow "I". In short, the seesaw type lever 20 is released from the rotating lever 22 and positioned so as to abut on another pin 23*a* in the rotating lever 23. The rotation of the take-up drum 28 is transmitted to the carriage 10 through the rope 29 to shift it in the line direction by a distance corresponding to one character against the coil spring 27. Consequently, the type wheel 8 for numerals is transferred up to the position where it faces the hammer head 19*a*. At this juncture, both type wheels 7 and 8 are rotated up to the predetermined position of stoppage due to the rotation of the step motor 12 for every time the printing of one character is completed before being ready for printing the next character.

Figure 10:
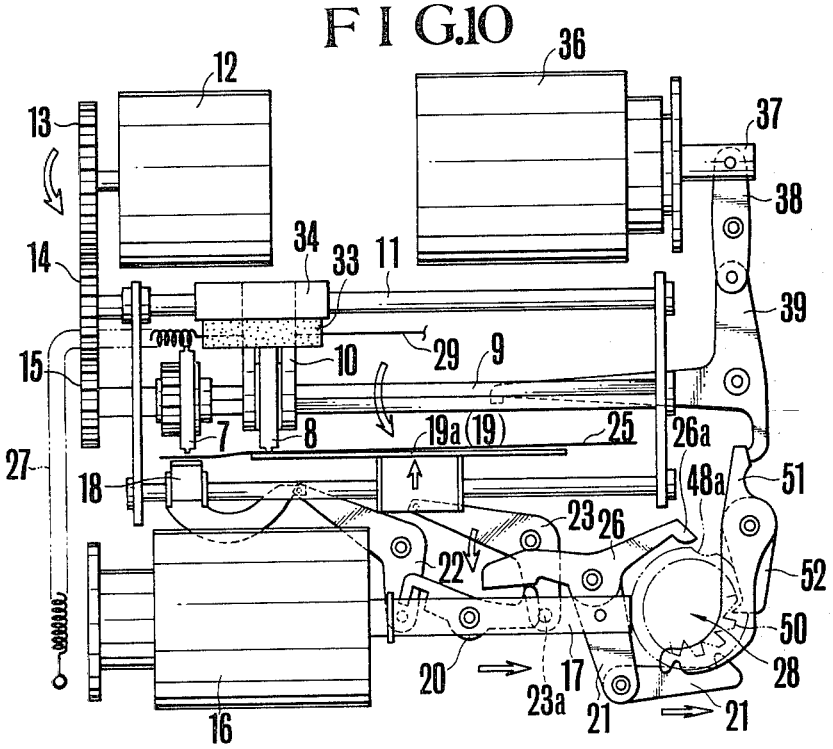
Figure 11:
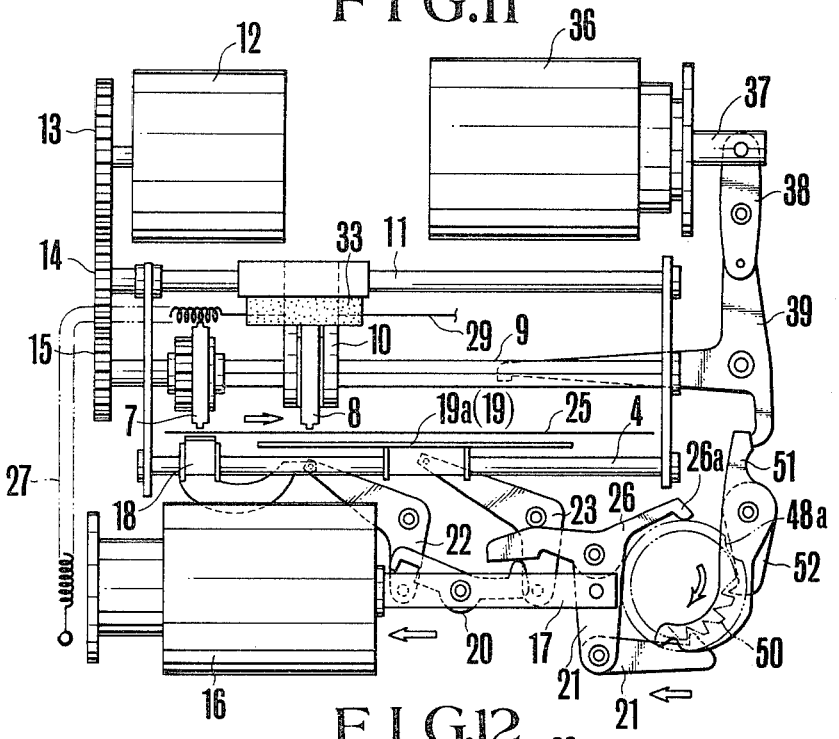

Next, when the subsequent printing instruction is provided from a memory circuit in which the print instruction for one line is memorized, the rotation of step motor 12 is likewise transmitted to the type wheel 8 through the spline shaft 9, and the type wheel 8 is stopped at the position where the hammer head 19*a* faces the numerical symbol on the type wheel 8 corresponding to the content of print instruction. And then, the electromagnetic plunger 16 is operated in response to the stoppage of the type wheel 8 as shown in FIG. 10 to actuate the hammer 19 by way of the seesaw type lever 20 on the operating lever 17 and the rotating lever 23. As the result of hitting the type wheel 8 by means of the hammer head 19*a* through the paper 25, the required symbol is printed on the paper 25. Due to the return operation of the operating lever 17, the hammerhead 19*a* is released from the type wheel 8 to rotate the ratchet 50 (take-up drum 28) and to shift the carriage 10 (type wheel 8) by a distance corresponding to one character by way of the rope 29 (refer to FIG. 11).

Figure 12:
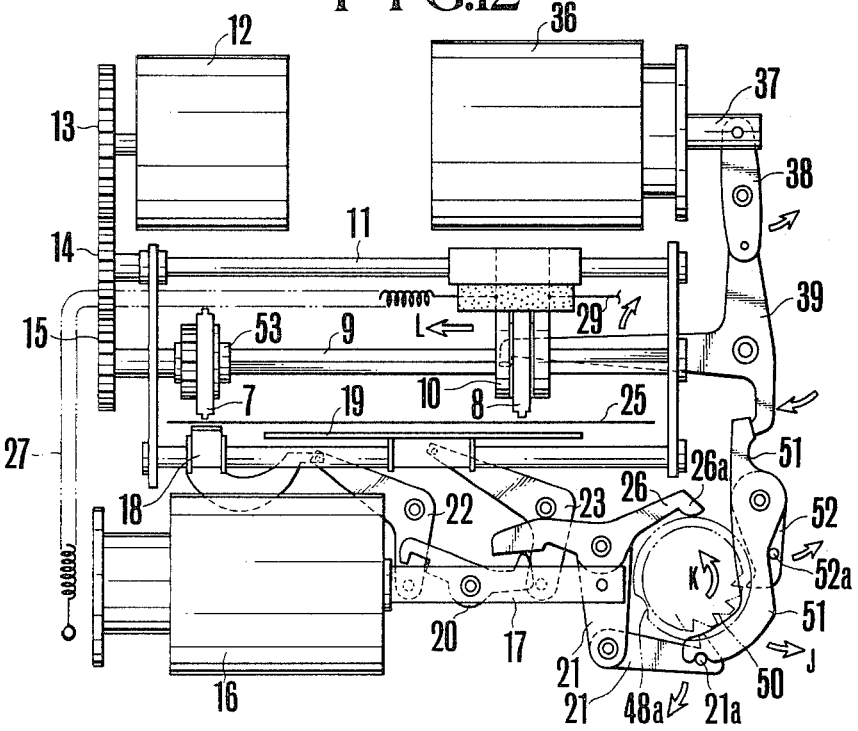

When the printing for one line is completed as the result of the repetition of the shifting and printing operation explained above, the second electromagnetic plunger 36 is actuated (the completion of printing for this one line is checked by the instruction from a digit discrimination circuit, for example, in an electronic desk top calculator) to rotate the release arm 51 in the direction of arrow "J" in FIG. 12 by way of the operating bar 37 of the plunger 36, the coupling lever 38, and the T-link 39. When rotated, the release arm 51 abuts on the pins 21*a* and 52*a* of the feed lever 21 and the detention claw 52, which are in engagement with the ratchet 50. Then, the feed lever 21 and the claw 52 are turned in the directions indicated by the respective arrows to release the engagement between the tooth portion in the ratchet 50 and both members 21 and 52. The ratchet 50 or take-up drum 28 which is now being placed under free condition with respect to the members 21 and 52 is rotated in the direction of arrow "K" due to the tractive force of the coil spring 27. At the same time, the carriage 10 is also transferred in the direction of arrow "L" by the coil spring 27. When the carriage 10 is returned to its start position for shifting and stopped there, the take-up drum 28 is also stopped to cause the projection 26*a* of the change-over arm 26 being depressed by the turning force of the seesaw type lever 20 to engage the concave portion 48*a* in the abutting portion 48.

Due to the operation of the electromagnetic plunger 36, the paper feed roller 5 is rotated by way of the T-link (Refer to FIG. 5), and the paper 25 is transferred up to the position suitable for the subsequent operation.

If the power to the electromagnetic plunger 26 is disconnected, the operating bar is returned to the initial position, and then the whole printing mechanism is restored to the printing start position for one new line as illustrated in FIG. 7. Alternately, the operating mechanism of the second electromagnetic plunger 36 may be formed in such manner that it can be operated several times at the time of completion for one line in response to the pitch of feeding the paper 25.

Figure 13:
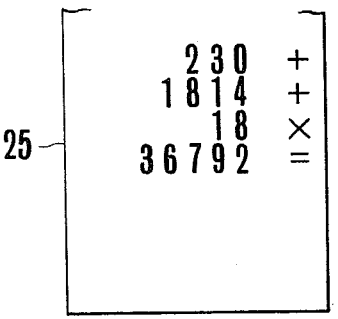
FIG. 13 is an explanatory diagram showing an example of character arrangement printed on a paper.

As clearly understood from the above explanation, in this embodiment, the printing for one line is so constituted that the function symbols as well as numerical symbols are printed one after another from the right end (or the least significant digit) of the paper 25 as illustrated in FIG. 13. In short, the printing mechanism is so constructed that, even if the printing of the type wheel 8 to be shifted is completed in the different number of digits due to the content of printing instruction for one line, it is immediately returned from its position to the start position for shifting.

As described above, the present invention is concerned with a serial type printing mechanism wherein the printing for each one character is performed as the result of shifting of the type wheel, and characterized in that the driving of the hammer (printing operation) and the shifting of the type wheel are achieved by means of the first electromagnetic plunger, and that the return operation of the type wheel to the start position for shifting and the paper feed operation are controlled by means of the second electromagnetic plunger, so that a remarkable saving of the driving source for its printing operation can be accomplished in the serial type printing mechanism. In addition, since the mechanism itself can be constructed to be simple and small, the printer in accordance with the present invention can be incorporated into an electronic desk top calculator. The printing mechanism is reliable in operation and can be manufactured at low cost.

In the foregoing the present invention has been described by reference to a specific illustrative device. It will be evident, however, that various modifications may be made without departing from the scope and spirit of the present invention.

What is claimed is:

1. A printing mechanism including:

a carriage movable laterally along a printing line and including a type wheel rotatable to position a selected one of a plurality of type elements carried by said type wheel into a printing position along said printing line;

means for holding said carriage in a selected position along said printing line, said holding means including a resilient element biasing said carriage toward a first position along said printing line, a drum interconnected to said carriage by a string held to said drum for moving said carriage to a selected position by rotation of said drum, a ratchet secured to said drum for rotation therewith and a retention means operatively engaged with said ratchet for holding it against rotation;

a hammer having a hammer head extending longitudinally along said printing line;

means for feeding paper between said hammer head and the type element in said printing position;

means including a first electromagnetic plunger operatively connected to said hammer and said ratchet for pivoting said hammer to cause said hammer head to strike the printing element in said printing position through said paper during movement of said first electromagnetic plunger in a first direction, and for rotating said ratchet to turn said drum and move said carriage laterally to the next printing position along said printing line during movement of said electromagnetic plunger in a second direction; and means for releasing said retention means from said ratchet to cause said carriage to return to said first position while actuating said paper feed means to advance said paper, said releasing and actuating means consisting essentially of a second electromagnetic plunger and means for transmitting motion from said second electromagnetic plunger to said retention means and said paper feeding means.

2. A printing mechanism according to claim 1, said type wheel being mounted on a shaft for rotation therewith, said type wheel being slidable along said shaft, and a stepping motor operatively connected to said shaft for rotating said type wheel to position a type element into said printing position.

3. A printing mechanism according to claim 1, said retention means including a movable pawl biased into engagement with said ratchet, said paper feeding means including a paper feed roller mounted to a rotatable shaft and a ratchet wheel mounted to said shaft for said paper feed roller, said motion transmitting means including a pivotal lever connected to said second electromagnetic plunger, said lever having a first arm adapted to move said pawl out of engagement with said ratchet and a second arm having a claw adapted to rotate said ratchet wheel during movement of said second electromagnetic plunger.

4. A printing mechanism according to claim 1, said pivoting and rotating means further including a hammer lever connected to said first electromagnetic plunger and adapted to engage said hammer and pivot same during forward movement of said first electromagnetic plunger, and a feed lever connected to an end portion of said first electromagnetic plunger, said feed lever carrying a claw adapted to ride over the teeth of said ratchet during forward movement of said electromagnetic plunger and engage one of said teeth to turn said ratchet during return of said first electromagnetic plunger.

5. A printing mechanism according to claim 4, including a second type wheel rotatable to position a selected one of a plurality of second type elements carried by said second type wheel into a printing position along said printing line, said second type wheel being laterally fixed in position along said printing line, a second hammer having a second hammer head located oppositely the printing position of said second type elements, said hammer lever being movable between two positions, a first of which engaging said hammer and a second of which engaging said second hammer.

6. A printing mechanism according to claim 5, further including means for changing said hammer lever from one of its positions to the other, said changing means including a change-over lever having a first arm adapted to ride on a cam element connected to said drum and a second arm connected to said hammer lever, said cam element being adapted to pivot said change-over lever to place said hammer lever into its second position engaging said second hammer during the printing of the first character of each line of print and into its first position thereafter.

* * * * *